US007347527B2

(12) United States Patent
Phillips et al.

(10) Patent No.: US 7,347,527 B2
(45) Date of Patent: Mar. 25, 2008

(54) SYSTEM AND METHOD FOR MAINTAINING SOLID INK PRINTHEADS

(75) Inventors: Scott J. Phillips, Henrietta, NY (US); Antonio L. Williams, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 401 days.

(21) Appl. No.: 11/094,944

(22) Filed: Mar. 30, 2005

(65) Prior Publication Data

US 2006/0227162 A1 Oct. 12, 2006

(51) Int. Cl.
*B41J 2/165* (2006.01)

(52) U.S. Cl. ..... 347/32; 347/33

(58) Field of Classification Search ..... 347/33, 347/29, 32

See application file for complete search history.

(56) References Cited

U.S. PATENT DOCUMENTS 4,636,803 A 1/1987 Mikalsen
4,739,339 A 4/1988 DeYoung et al.
5,038,157 A 8/1991 Howard
5,372,852 A 12/1994 Titterington et al.
5,493,319 A 2/1996 Hirabayashi et al.
6,053,608 A 4/2000 Ishii et al.
6,293,648 B1 9/2001 Anderson
6,578,949 B2 * 6/2003 Takahashi et al. ..... 347/30
6,588,876 B2 * 7/2003 Taylor et al. ..... 347/32
6,663,215 B2 * 12/2003 Klausbruckner et al. ..... 347/22
6,764,160 B1 * 7/2004 Phillips et al. ..... 347/32
6,783,221 B2 8/2004 Phillips

* cited by examiner

*Primary Examiner*—Julian D. Huffman
*Assistant Examiner*—Jason Uhlenhake
(74) *Attorney, Agent, or Firm*—Fay Sharpe LLP

(57) ABSTRACT

A maintenance assembly and method for insulating printer/copier solid ink printheads. The maintenance assembly includes a car movably supported for travel along a maintenance path interposed between a first printhead and an ink receiving surface from a home position to a completion position and a wiper extending from the car for wiping the printhead front faces as the car moves along the path. The method includes moving a car having a wiper extending therefrom along a maintenance path interposed between the printhead front faces and the ink receiving surface parallel to the front faces for wiping the first and second printhead front faces.

20 Claims, 7 Drawing Sheets

SYSTEM AND METHOD FOR MAINTAINING SOLID INK PRINTHEADS

CROSS REFERENCE TO RELATED APPLICATIONS

This application is related to U.S. patent application to Williams, et al., Ser. No. 11/093,503 filed Mar. 30, 2005.

BACKGROUND

Illustrated herein are embodiments relating to a method and apparatus for maintaining printer/copier printheads. It finds particular application in conjunction with an imaging apparatus having solid ink printheads, and will be described with particular reference thereto. However, it is to be appreciated that the present exemplary embodiment is also amenable to other like applications.

Image producing machines, such as printers and/or copiers and the like, often use printheads for ejecting ink onto an ink receiving surface, such as print media also referred to as the substrate, or an image drum which is then transferred to the print media, to form an image thereon. Solid ink image producing machines use solid ink, also referred to as phase change ink. The solid ink is in the solid phase at ambient temperature and is melted to a molten, liquid phase at an elevated, operating temperature. At the operating temperature, droplets or jets of the molten liquid ink are ejected from one or more printhead front faces to form the image. When the ink droplets contact the surface of the substrate, they quickly solidify to create an image in the form of a predetermined pattern of solidified ink drops.

An example of such a solid ink image producing machine or printer, and the process for producing images therewith onto image receiving sheets is disclosed in U.S. Pat. No. 5,372,852 issued Dec. 13, 1994 to Titterington et al. As disclosed therein, the solid ink printing process includes raising the temperature of a solid form of the solid ink so as to melt it and form a molten liquid ink. It also includes applying droplets of the solid ink in a liquid form onto an imaging surface in a pattern using a device such as an ink jet printhead. The process then includes solidifying the solid ink droplets on the imaging surface, transferring them the image receiving substrate, and fixing the solid ink to the substrate.

The ink droplets are ejected from orifices in the printhead front faces. During printing and after printing is completed ink can build up on the printhead front faces. The buildup of this waste ink can interfere with the proper ejection of ink droplets and degrade quality of the image formed. It is therefore desirable to remove waste ink on occasion.

BRIEF DESCRIPTION

A maintenance assembly and method for maintaining solid ink printheads is provided.

In accordance with one aspect of the embodiments described herein, the maintenance assembly includes a car movably supported for travel along a path interposed between a first printhead and a receiving surface from a home position to a completion position, a wiper having a body extending from the car and a blade for wiping the printhead front faces as the car moves along the path.

In accordance with a second aspect of the embodiments described herein, the solid ink printheads include a lower printhead having a front face disposed in a first plane and an upper printhead having a front face disposed in a second plane forming an angle with the first plane. The maintenance assembly can include a track for guiding the car along the path having a first portion, a second portion communicating with the first portion and extending parallel to the second plane for guiding the wiper parallel to the upper printhead front face, and a third portion communicating with the second portion and extending parallel to the first plane for guiding the wiper parallel to the lower printhead front face.

In accordance with another aspect of the embodiments described herein, a method for maintaining solid ink printheads including a first printhead having a front face disposed in a first plane for ejecting ink onto a receiving surface and a second printhead having a front face disposed in a second plane for ejecting ink onto the receiving surface is provided. The method includes moving a car having a wiper extending therefrom along a path interposed between the first printhead and the receiving surface parallel to the first and second planes for wiping the first and second printhead front faces of waste ink.

Further scope of the applicability of the embodiments provided herein will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DETAILED DESCRIPTION

Figure 1:
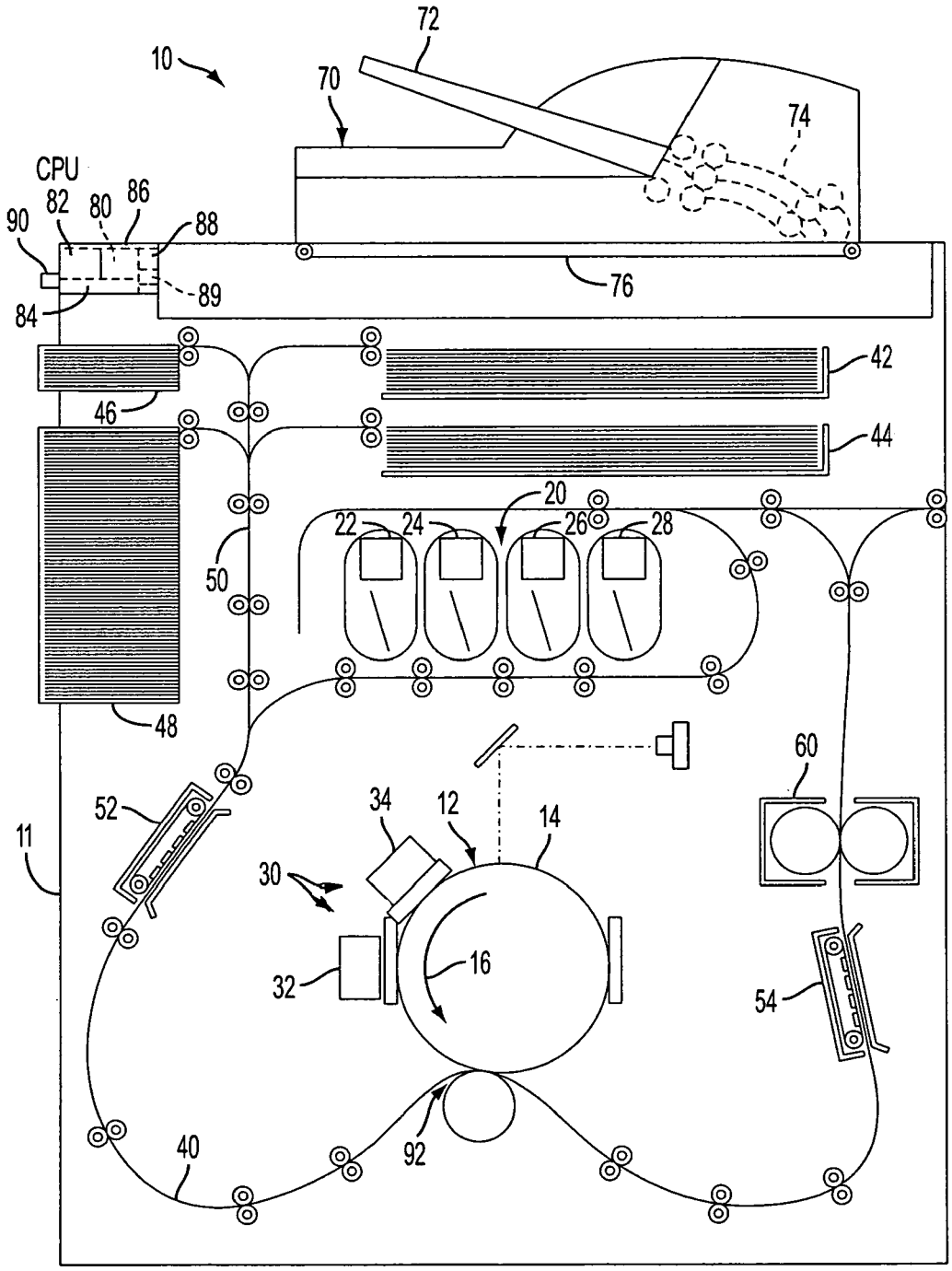
FIG. 1 is block diagram of a printer/copier.

With reference to FIG. 1, there is illustrated an image producing machine, such as the solid ink image producing machine 10, referred to herein as a printer/copier. The printer/copier 10 can be a copier, printer, or multifunction device using molten solid ink to form an image on a substrate as described below.

The printer/copier 10 includes a frame 11 to which are mounted directly or indirectly all its operating subsystems and components, as will be described below. To start, the printer/copier includes an imaging member 12 that is shown in the form of a drum, but can equally be in the form of a supported endless belt. The imaging member 12 has an imaging surface 14, also referred to herein as an ink receiving surface, which receives molten solid ink ejected from printheads 30 to form images. The receiving surface 14 is movable with respect to the printheads 30 along a receiving surface path as shown by arrow 16.

The printer/copier 10 also includes a solid ink delivery subsystem 20 that has at least one source 22 of one color solid ink in solid form. The printer/copier 10 can be a multicolor image producing machine having an ink delivery system 20 which includes four sources 22, 24, 26, 28, representing four different colors CYMK (cyan, yellow, magenta, black) of solid inks. The solid ink delivery system 20 also includes a melting and control apparatus (not shown in FIG. 1) for melting or phase changing the solid ink from a solid form into a liquid form. The solid ink delivery system 20 is suitable for supplying the ink in liquid form to printheads 30 which eject the ink onto the receiving surface 14, when forming an image. In other applicable examples, the receiving surface 16 can be the substrate. In these examples, the receiving surface path 16 can be the path taken by the substrate during the image forming process which can be referred to as the substrate path, also referred to as the substrate handling path, also referred to as the paper path.

As further shown, the printer/copier 10 includes a substrate supply and handling system 40. The substrate supply and handling system 40 can include a plurality of substrate supply sources 42, 44, 46, 48, of which supply source 48, for example, is a high capacity paper supply or feeder for storing and supplying image receiving substrates in the form of cut sheets. The substrate supply and handling system 40 can include a substrate handling and treatment system 50 that has a substrate pre-heater 52, substrates and image heater 54, and a fusing device 60. The printer/copier 10 can also include an original document feeder 70 that has a document holding tray 72, document sheet feeding and retrieval devices 74, and a document exposure and scanning system 76.

Operation and control of the various subsystems, components and functions of the printer/copier 10 are performed with the aid of a controller 80. The controller 80 can be a self-contained, dedicated computer having a central processor unit (CPU) 82, electronic storage 84, and a display or user interface (UI) 86. The controller 80 can include sensor input and control means 88 as well as a pixel placement and control means 89. The CPU 82 reads, captures, prepares and manages the image data flow between image input sources such as the scanning system 76, or an online or a work station connection 90, and the printheads 30. As such, the controller 80 is the main multi-tasking processor for operating and controlling other machine subsystems and functions, including timing and operation of the maintenance assembly as described below.

In operation, image data for an image to be produced is sent to the controller 80 from either the scanning system 76 or via the online or work station connection 90 for processing and output to the printheads 30. Additionally, the controller 80 determines and/or accepts related subsystem and component controls, for example from operator inputs via the user interface 86, and accordingly executes such controls. As a result, appropriate color solid forms of phase change ink are melted and delivered to the printheads 30 in a known manner. Additionally, pixel placement control is exercised relative to the imaging surface 14 thus forming desired images per such image data, and receiving substrates are supplies by anyone of the sources 42, 44, 46, 48 and handled by means 50 in timed registration with image formation on the surface 14. Finally, the image is transferred within the transfer nip 92, from the receiving surface 14 onto the substrate for subsequent fusing at fusing device 60.

Figure 2:
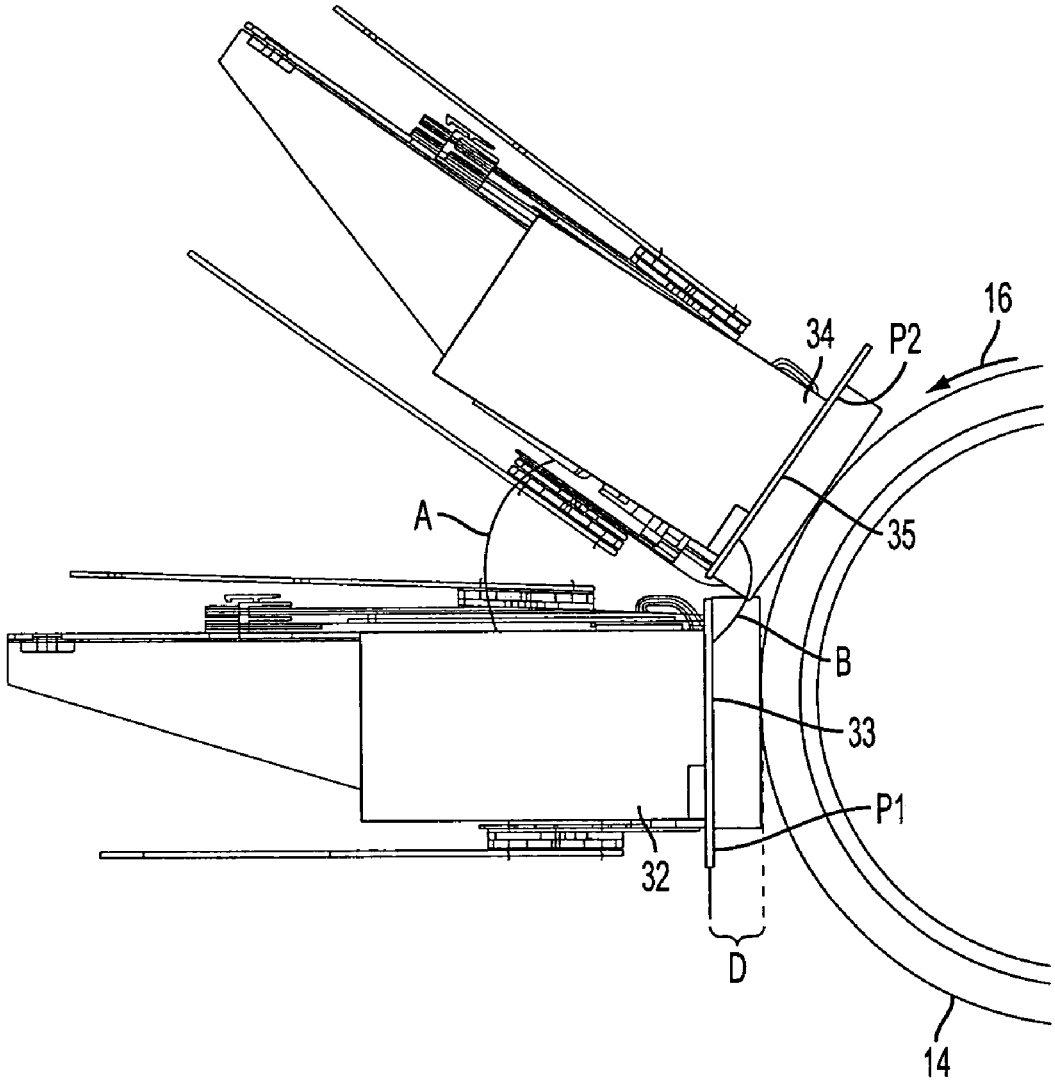
FIG. 2 is block diagram of upper and lower printheads having front faces disposed along first and second planes.
Figure 3:
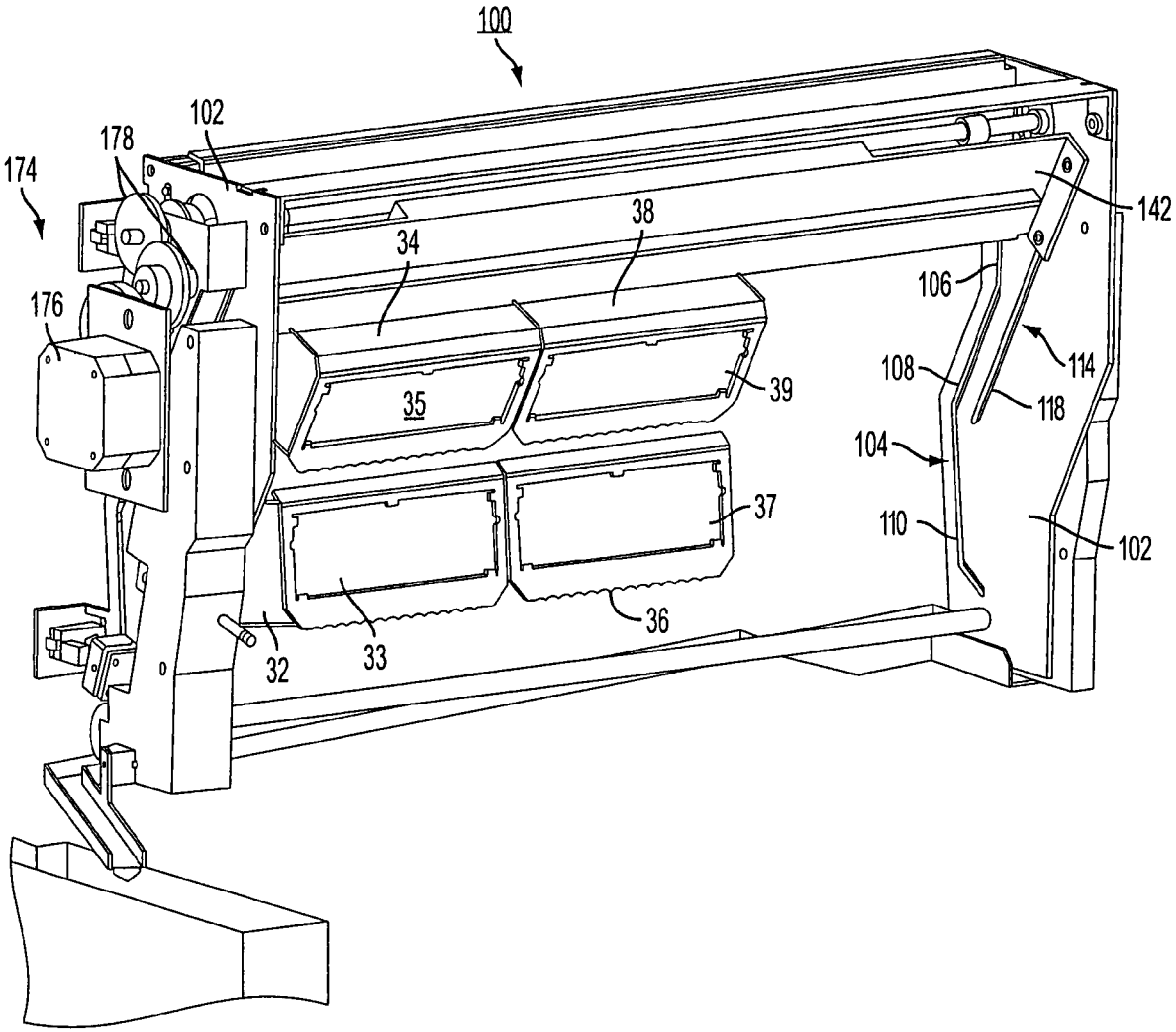
FIG. 3 is perspective view of the maintenance assembly.

Referring now to FIGS. 2 and 3, the printer/copier 10 described in this example is a high-speed, or high throughput, multicolor image producing machine, having four printheads 30, including lower printheads 32 and 36, and upper printheads 34 and 38. Each printhead 32, 34, 36 and 38 has a corresponding front face 33, 35, 37 and 39 for ejecting ink onto the receiving surface 14 as the receiving surface travels along the receiving surface path 16 to form an image. However, it should be appreciated that the maintenance assembly described herein is suitable for maintaining a single upper and lower printhead or more than two upper and two lower printheads.

While forming an image, a mode referred to herein as print mode, the upper printheads 32, 36 are staggered with respect to the lower printheads 34, 38 in a direction transverse to the receiving surface path 16 in order to cover different portions of the receiving surface 14. The staggered arrangement enables the printheads 30 to form an image across the full width of the substrate. In print mode the printhead front faces 33, 35, 37, 39 are disposed close to the imaging surface 14, for example about 23 mils.

When the printer/copier 10 enters the maintenance mode, the printheads 30 are moved to a maintenance position. In the maintenance position the printheads 32, 34, 36, 38 are moved from their print mode staggered orientation, to an aligned orientation as shown in FIG. 3. In the aligned orientation, one or more upper printheads, in this example printheads 34 and 38, are aligned on top of corresponding one or more lower printheads, 32 and 36 respectively, to minimize heat loss. However, it should be appreciated that the upper printheads do not have to be aligned on top of the lower printheads for the maintenance assembly described herein to wipe the printhead front faces as described herein.

Also, in the maintenance mode, the printheads 30 are retracted, that is moved away, from the receiving surface 14 so that the printhead front faces 33, 35, 37, and 39 are disposed a distance D from the receiving surface. The distance D is greater than the distance of the printhead front faces from the receiving surface 14 when the printheads are in the printing position. In the example provided, D is about one inch, though D can be a lesser or greater distance. The printheads can be moved by apparatus suitable for changing their position and orientation, such as those described in U.S. Pat. No. 6,764,160 B1, which is hereby incorporated by reference herein.

In the maintenance position, the upper printheads 34, 38 can form an angle, shown as A, with respect to the corresponding lower printheads 32, 36. Angle A is typically less than about 90 degrees and in the example provided herein, A is about 36°. In the maintenance position, the lower printhead front faces 33 and 37 are disposed along a first plane, shown as P1, and the upper printhead front faces 35 and 39 are disposed along a second plane, shown as P2. The first plane P1 forms an angle, shown as B, with respect to the second plane P2. The angle B is determined to be 180°-A. In this example, B is about 144°.

Figure 4:
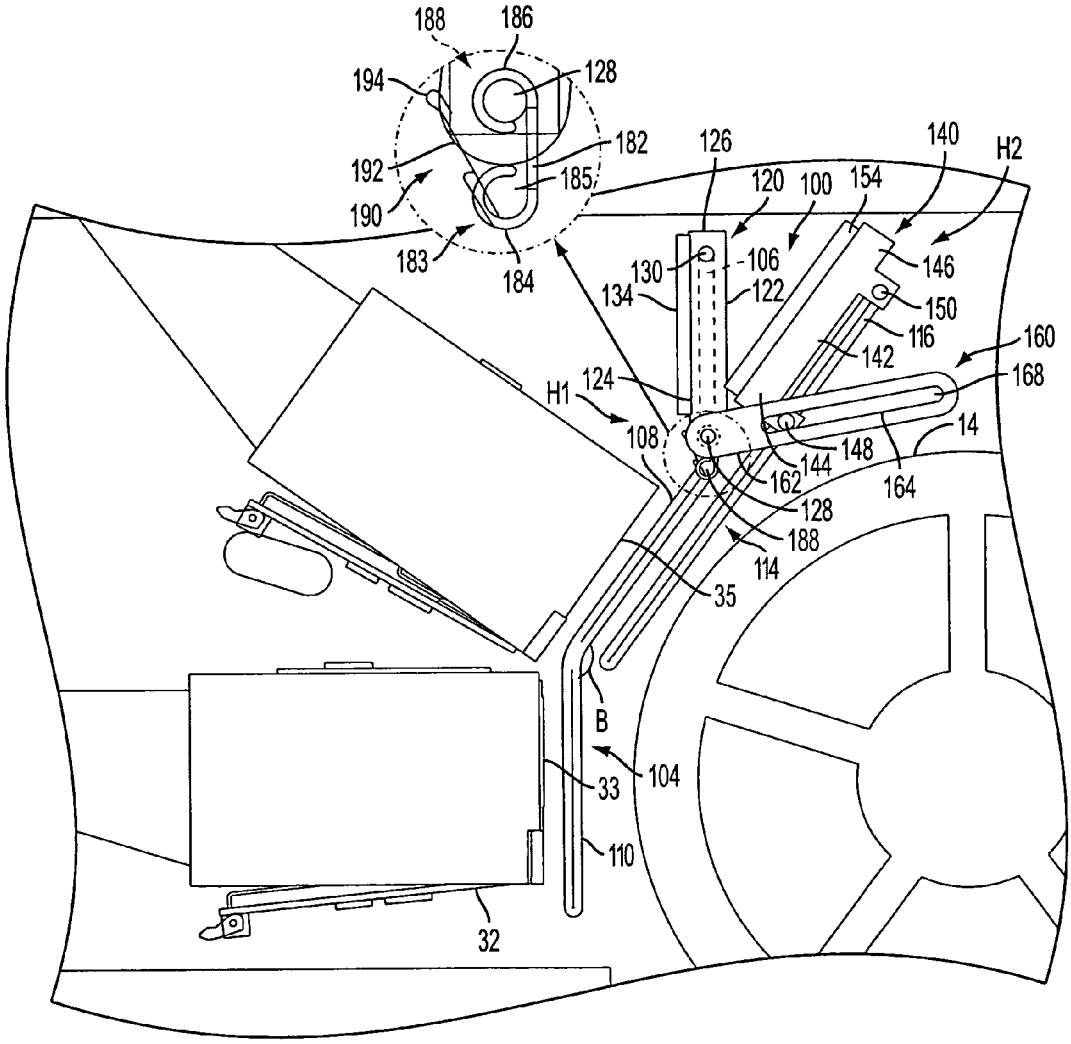
FIG. 4 is a block diagram illustrating a first embodiment of the maintenance assembly having a car disposed in the home position.

Referring to FIGS. 3 and 4, the printer/copier 10 can also include maintenance assembly, shown generally at 100, for wiping the printheads 30 in the maintenance mode. The maintenance assembly 100 can include one or more support plates 102 connected to the frame 11. In the example described herein, two support plates 102 are disposed in a spaced apart, approximately parallel, relationship with one on each side of the printheads 30 when the printheads are disposed in the maintenance position described above.

The maintenance assembly 100 can include a first contoured track 104 having a first portion 106, a second portion 108 and a third portion 110. In the example provided herein, the contoured track 104 is formed by a contoured slot 104 in the support plates 102. For the purposes of clarity, the support plates 102 are not shown in FIGS. 4-11, although the slots forming the tracks are shown in FIGS. 4-8 and 10-11.

The contoured slot 104 can include a first slotted portion 106 (shown as a dotted line in FIG. 4), a second slotted portion 108 extending from, thereby communicating with, the first slotted portion, and a third slotted portion 110 extending from, thereby communicating with, the second slotted portion. The second portion 108 of the track extends along the support plates 102 parallel to the second plane P2 and the third portion 110 of the track extends along the support plates 102 parallel to the first plane P1. In the example provided, the contoured slot 104 extends through the two support plates 102, however, it should be appreciated that the contoured track 104 can be formed in other manners, such as for example, by a contoured groove, among others.

The maintenance assembly 100 can include a second track 114 having a first portion 116, and a second portion 118. In the example provided herein, the second track 114 is formed by a second slot 114 in the support plates 102. The second slot 114 includes a first slotted portion 116 and a second slotted portion 118 extending from, thereby communicating with, the first slotted portion. The second portion 118 extends along the support plates 102 parallel to the second plane P2. In the example provided, the second slot 104 extends through the two support plates 102, however, it should be appreciated that the second track 114 can also be formed in other manners, such as for example, by a groove.

The maintenance assembly 100 can also include a first car 122 having a front end 124 and a back end 126 disposed opposite the front end. Each side of the front end 126 is connected to the first track 104 via a pivot pin, only one of which is shown as 128. Each side of the back end 126 is also connected to the first track 104 via a pivot pin, only one of which is shown as 130. The pivot pins 128 and 130 create pivoting connections between the first track 104 and both ends 124, 126 of the first car 122 which support the first car for movement along the first track and enable the front end 124 and back end 126 to simultaneously move along different portions of the first track 104 as shall be described in further detail below.

The maintenance assembly 100 can also include a second car 142 having a front end 144, and a back end 146 disposed opposite the front end. Each side of the first and second ends 144, 146 are connected to the second track 114 via pivot pins, 148 and 150 respectively. The pivot pins 148 and 150 create pivoting connections between the second track 114 and both ends 144, 146 of the second car 142 thereby supporting the second car for movement along the second track.

The maintenance assembly 100 can also include a car-to-car linkage 160 for connecting the first car 122 to the second car 142. The linkage 160 can include a first end 162 pivotally connected to the first end 124 of the first car 122 via the pivot pin 128. The linkage 160 can also include a slot 164 receiving the second car pivot pin 148 for providing a sliding connection between the linkage and the second car 142. The slot 164 includes a first end 168 for abutting the pivot pin 148 at the first end 144 of the second car 142 to provide a pulling force to the second car thereby pulling the second car behind the first car 122 as the first car travels along a first path M1, as shall be described in further detail below.

Figure 5:
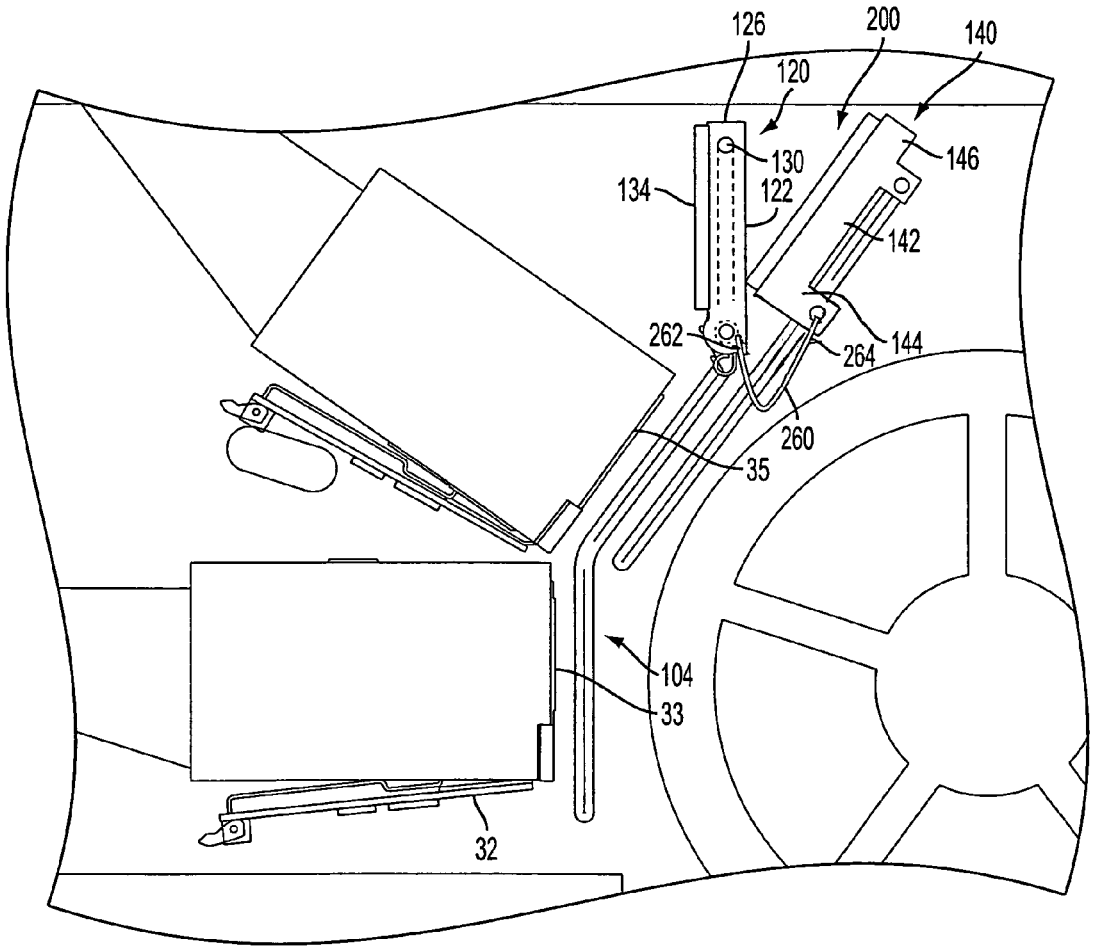
FIG. 5 is a block diagram illustrating a second embodiment of the maintenance assembly.

It should be appreciated that the car-to-car linkage 160 providing the connection between the first and second cars 122, 142 is shown for the purposes of example, and other connections can be used. Referring to FIG. 5, another embodiment of the maintenance assembly is illustrated at 200 in which some components similar to those shown in FIG. 4 are referenced with similar reference numerals. The second embodiment 200 includes a car-to-car linkage 260 connecting the first car 122 to the second car 142 that is a flexible cable. The flexible cable 260 provides little to no stretch axially along it's length. In this embodiment, the flexible cable 260 is formed of wire having a first end 262 connected to the first end 124 of the first car 122 and a second end 264 connected to the first end 144 of the second car 142. The flexible cable 260 has a length that is approximately longer than the first car 122, sufficient to allow the second car 142 to be pulled behind the first car 122 as the first car moves along the first path M1.

The maintenance assembly 100 can also include a spring 170 (shown in FIG. 6) connected to the second car 142 for biasing the second car towards the home position H2 as shown by arrow S and described in further detail below. The spring 170 can be an extension spring, a compression spring, a clock spring or any other spring suitable for biasing the second car 142 in the home position H2.

The maintenance assembly 100 can also include a third car 182 having a front end 184 and a back end 186. The third car 182 can be formed of a rigid material, such as metal which can be in the form of sheet metal, or other suitable materials. The third car 182 can be connected to the track 104 by a pivot connection 183 formed by pivot pins, one of which is shown at 185, extending through pin receiving apertures on each side of the car enabling the third car 182 to pivot with respect to the track 104. The back end of the third car 186 is pivotally connected to the front end of the first car 124 via a pivot connection 188. The pivot connection 188 can be formed by forming a pin receiving aperture or apertures in the third car 182 for receiving the pivot pins 128, or in other suitable manners. The pivot connection 188 enables the third car 182 to pivot with respect to the track 104 and with respect to the first car 122 as the cars travel along the track 104. The pivot pins 128 connect both sides of the back end 186 of the third car 182 to the track 104.

The maintenance assembly 100 can also include a wiper 190 having a body 192 extending from the third car 182. The body is formed of a rigid but flexible material capable of yielding when it comes into contact with the printheads 30 while still providing a wiping force against the printhead front faces 33, 35, 37, 39. By way of example, the wiper body 192 can be formed of spring steel, though other suitable materials can be used. The wiper 190 also includes a blade 194 for wiping the printhead front faces 33, 35, 37, 39 to remove ink, such as for example waste ink, and debris as described in further detail below. The wiper blade 194 can be formed of silicone, vinyl, or other pliable materials.

The maintenance assembly 100 can also include a drive mechanism 174 for moving the third car 182 along the track 104. The drive mechanism 174 can include a motor 176 connected to the third car 122 by a drive belt 178. The drive belt 178 can be clamped by a clamp attached to the pivot pin 128. The operation of the motor 176 is controlled by the controller 80.

The operation of the printhead maintenance assembly 100 shall be described with reference to FIGS. 4-9 in which only printheads 32 and 34 and respective printhead front faces 33 and 35 are shown for clarity, however it should be appreciated that printheads 36 and 38 and respective printhead front faces 37 and 39 are also being wiped by the maintenance assembly 100, 200 in a similar manner. Referring to now FIG. 4, the third car is disposed in a home position H1. In the home position H1, the first and second cars 122, 142 are stacked together to occupy less space, and all cars 122, 142 and 182 are located away from the printheads 30 so as not to interfere with them during printing. In the home position, the third car 182 is not disposed between the printhead front faces and the ink receiving surface. When the printer/copier 10 is switched from print mode to maintenance mode, the controller 80 initiates operation of the drive unit 174 which moves the third car 122 along the first track 104 along the maintenance path shown as the dotted line M1 in FIG. 6. The third car 182 is moved along the maintenance path M1 from the home position H1 to a completion position C1 (shown in FIG. 9). The maintenance path M1 taken by the third car 182 is interposed between the printhead front faces 33, 35, 37, 39 and the receiving surface 14. As the third car 182 moves along the path M1, the wiper blade 194 wipes the printhead front faces 33, 35, 37, 39.

Figure 6:
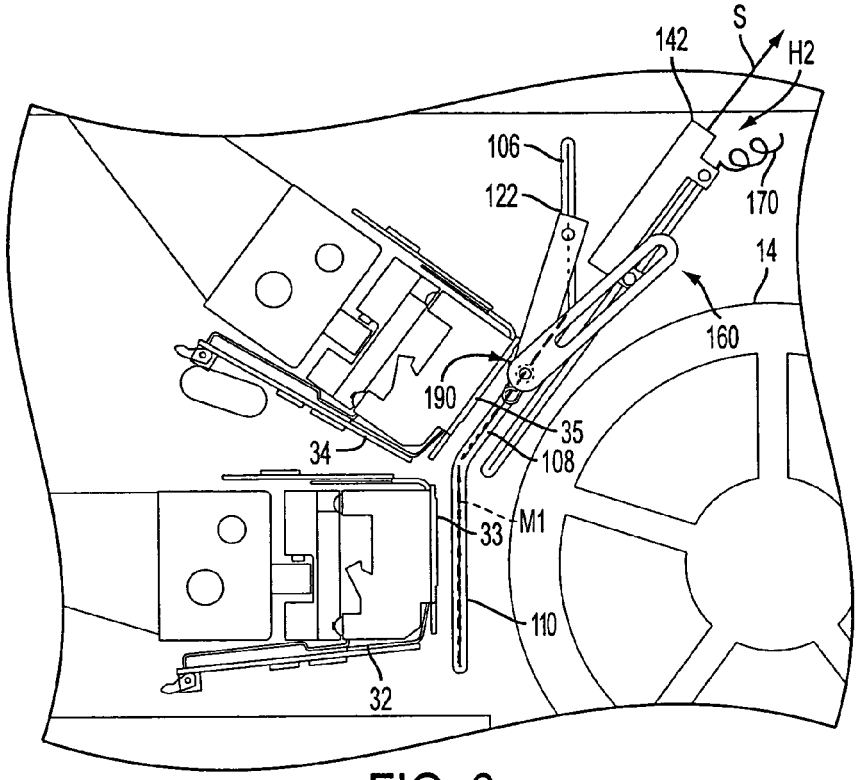
FIG. 6 is a block diagram illustrating the car moving along the path M1 with the wiper wiping the upper printhead front face.

Referring to FIG. 6, the third car 182, along with the first car 122 connected thereto, is shown moving along the path M1 away from the first home position H1. The second car 140 is held stationary by the spring 170. The wiper 194 is shown wiping the upper printhead front faces 35, 39 for removing ink therefrom. Since the second portion 108 of the first track 104 is parallel to the second plane P2, and thus the upper printhead front faces 35, 39, the third car 182 moves parallel to the front faces and the wiper 190 provides a relatively constant wiping pressure against these front faces as the wiper blade 194 wipes across them.

Figure 7:
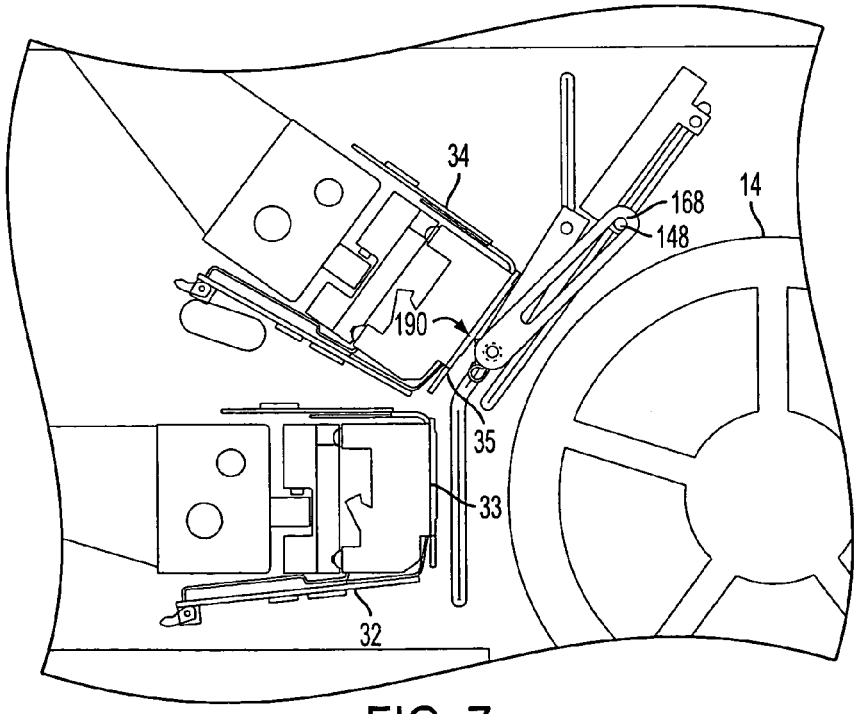
FIG. 7 is a block diagram illustrating the car moving along the path M1 with the wiper wiping the upper printhead front face.

Referring now to FIG. 7, the first car 122 begins to pull the second car 142 via the linkage 160 or 260. In the embodiment 100 having the slotted linkage 160, the first end 168 of the slot 164 abuts the second car pivot pin 148 to transfer the pulling force from the first car 122 to the second car 142. In the embodiment 200 having the flexible linkage 260, the flexible linkage pulls taught and then begins to transfer this pulling force to pull the second car 142. The wiper 194 continues to wipe the upper printhead front faces 35, 39.

Figure 8:
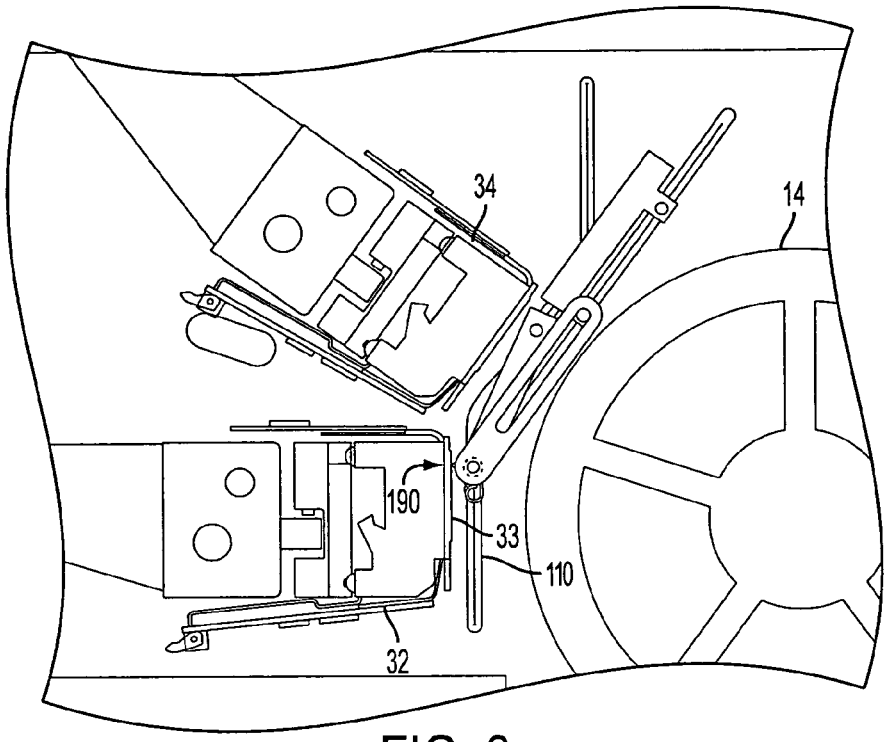
FIG. 8 is a block diagram illustrating the car moving along the path M1 with the wiper wiping the lower printhead front face.

Referring now to FIG. 8, the third car 182 enters the third portion 110 of the first tack 104 and the wiper 194 begins to wipe the lower printhead front faces 33, 37. Since the third portion 110 of the first track 104 is parallel to the first plane P1, and thus the lower printhead front faces 33, 37, the third car 182 moves parallel to the front faces and the wiper 190 provides a relatively constant wiping pressure against these front faces as the wiper blade 194 wipes across them.

Figure 9:
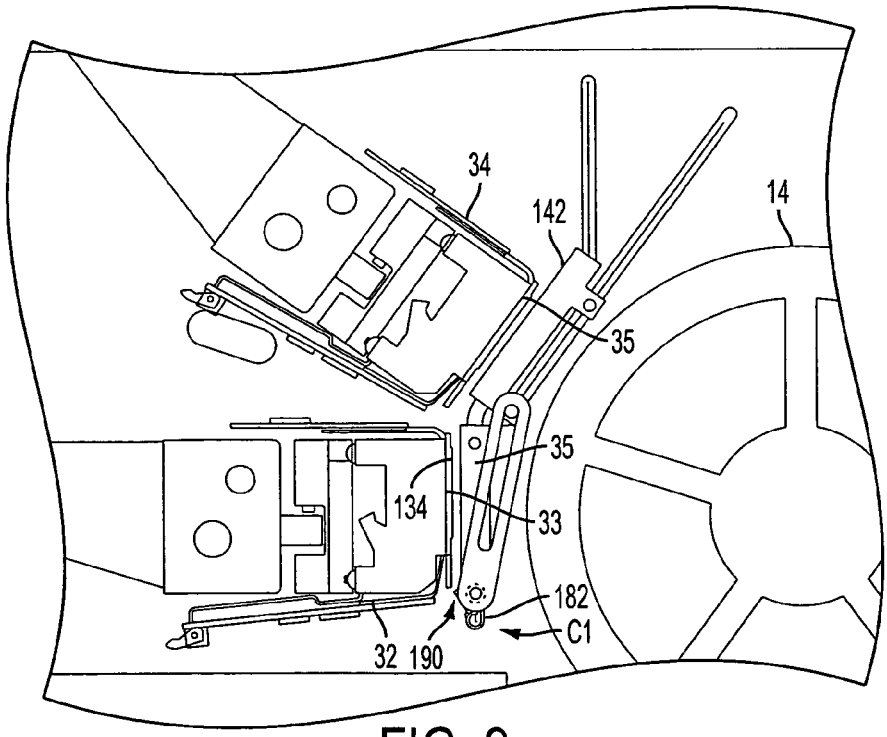
FIG. 9 is a block diagram illustrating the car in the completion position.

In FIG. 9, the third car 182 has reached the completion position C1 and the wiper 190 has finished wiping the lower printhead front faces 35, 39. When the printer/copier 10 is switched back to the print mode for forming an image on the receiving surface 14, the controller 80 causes the drive unit 174 to move the third car 182 back in the opposite direction along the maintenance path M1 returning the third car back to the home position H1. The first car 122 and second car 142 also move back to the positions shown in FIG. 4.

The advantages of the maintenance assembly 100, 200 described herein include wiping one or more upper and lower printhead front faces 33, 35, 37, 39 disposed in different planes P1 and P2, while occupying a minimal space within the printer/copier 10. The planes P1 and P2 can form an angle with respect to each other.

The operation of the embodiments described herein illustrate a method for insulating the solid ink printheads 33, 34, 36, 38 having front faces 33, 35, 37, 39 disposed in different planes. The method can include moving a car having a wiper extending therefrom along a maintenance path M1 interposed between the first and second printhead front faces and the receiving surface. The first printhead front face is disposed in a first plane P1 and the second printhead front face is disposed in a second plane P2. The first and second planes P1, P2 can form an angle with respect to each other. The maintenance path M1 is parallel to the first and second planes. The method can include also wiping the first and second printhead front faces with the wiper.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A maintenance assembly for maintaining solid ink printheads including a first printhead having a front face for ejecting ink onto an ink receiving surface and a second printhead having a front face for ejecting ink onto the receiving surface, the maintenance assembly comprising:

a car movably supported for travel along a maintenance path interposed between the printheads and the receiving surface from a home position to a completion position, the car having a front end and a back end;

a track for guiding the car along the maintenance path;

a first connector pivotally connecting the front end of the car to the track;

a second connector pivotally connecting the back end of the car to the track; and a wiper having a body extending from the car and a blade for wiping the printhead front faces as the car moves along the maintenance path.

2. The maintenance assembly defined in claim 1, wherein the first printhead is a lower printhead having a front face disposed in a first plane and the second printhead is an upper printhead having a front face disposed in a second plane forming an angle with the first plane and the maintenance path is interposed between the upper and lower printhead front faces and the ink receiving surface.

3. The maintenance assembly defined in claim 2 wherein the track comprises:

a first portion;

a second portion communicating with the first portion and extending parallel to the second plane for guiding the wiper parallel to the upper printhead front face; and a third portion communicating with the second portion and extending parallel to the first plane for guiding the wiper parallel to the lower printhead front face.

4. The maintenance assembly defined in claim 3, further comprising a pair of spaced apart support plates having contoured grooves forming the track.

5. The maintenance assembly defined in claim 4 wherein the first connector includes first and second pivot pins each connecting opposite sides of the first end of the car to the track and the second connector includes first and second pivot pins each connecting opposite sides of the second end of the car to the track.

6. The maintenance assembly defined in claim 1 wherein the wiper body is formed of a flexible rigid material for biasing the blade against the printheads for wiping.

7. The maintenance assembly defined in claim 6 wherein the wiper body is formed of spring steel.

8. The maintenance assembly defined in claim 6 further comprising:

a drive unit connected to the car for moving the car along the maintenance path.

9. The maintenance assembly defined in claim 1 further comprising a second car pivotally connected to the back end of the car, the second car being pivotally connected to the track by a pivot pin for movement along a portion of the maintenance path.

10. The maintenance assembly defined in claim 9 further comprising a third car connected to a second track, the third car being connected to the second car via a linkage for pulling the third car behind the second car along a portion of the maintenance path.

11. The maintenance assembly defined in claim 10 wherein the linkage includes a slot for receiving the second car pivot pin for providing a sliding connection between the linkage and the third car.

12. The maintenance assembly defined in claim 10 wherein the linkage is a flexible linkage.

13. An image producing machine comprising:

a first printhead having a front face for ejecting ink onto a receiving surface;

a second printhead having a front face for ejecting ink onto the receiving surface, wherein the first printhead is a lower printhead having a front face disposed in a first plane and the second printhead is an upper printhead having a front face disposed in a second plane forming an angle with the first plane;

a car movably supported for travel along a maintenance path interposed between the first and second printheads and the receiving surface from a home position to a completion position, the car having a front end and a back end;

a track for guiding the car along the maintenance path;

a first connector pivotally connecting the front end of the car to the track:

a second connector pivotally connecting the back end of the car to the track; and a wiper having a body extending from the car and a blade for wiping the printhead front faces as the car moves along the maintenance path.

14. The image producing machine defined in claim 13 further comprising a plurality of lower printheads having front faces disposed in a first plane and a plurality of upper printheads having front faces disposed in a second plane forming an angle with the first plane.

15. The image producing machine defined in claim 13 wherein the track comprises:

a first portion;

a second portion communicating with the first portion and extending parallel to the second plane for guiding the wiper parallel to the upper printhead front face; and a third portion communicating with the second portion and extending parallel to the first plane for guiding the wiper parallel to the lower printhead front face.

16. The image producing machine defined in claim 13 wherein the wiper body is formed of a flexible rigid material for biasing the blade against the printheads for wiping.

17. An image producing machine defined in claim 13 further comprising a second car pivotally connected to the back end of the car, the second car being pivotally connected to the track by a pivot pin for movement along a portion of the maintenance path.

18. An image producing machine defined in claim 17 further comprising a third car connected to a second track, the third car being connected to the second car via a linkage for pulling the third car behind the second car along a portion of the maintenance path.

19. An image producing machine defined in claim 18 wherein the linkage includes a slot for receiving the second car pivot pin for providing a sliding connection between the linkage and the third car.

20. An image producing machine defined in claim 18 wherein the linkage is a flexible linkage.

* * * * *